US008137033B1

(12) United States Patent
Hinshaw et al.

(10) Patent No.: US 8,137,033 B1
(45) Date of Patent: Mar. 20, 2012

(54) MESH HANDLING SYSTEM FOR AN UNDERGROUND MINING MACHINE AND RELATED METHODS

(75) Inventors: Gregory E. Hinshaw, Proctorville, OH (US); Henry E. Wilson, Ironton, OH (US); Timothy D. Burgess, South Point, OH (US); William G. Kendall, Jr., Spanish Fork, UT (US); Jonathan R. Duncan, Milton, WV (US)

(73) Assignee: J.H. Fletcher & Co., Huntington, WV (US)

( * ) Notice: Subject to any disclaimer, the term of this patent is extended or adjusted under 35 U.S.C. 154(b) by 250 days.

(21) Appl. No.: 12/534,426

(22) Filed: Aug. 3, 2009

(51) Int. Cl.
*E21D 19/00* (2006.01)

(52) U.S. Cl. ..... 405/302.3; 405/288

(58) Field of Classification Search ..... 405/288, 405/302.3
See application file for complete search history.

(56) References Cited

U.S. PATENT DOCUMENTS 3,399,927 A 9/1968 Groetschel
4,003,208 A * 1/1977 Hornung et al. ..... 405/302.3
4,099,785 A 7/1978 Groetschel
4,122,682 A 10/1978 Groetschel
4,196,935 A * 4/1980 Dring ..... 299/11
4,229,043 A * 10/1980 Bell et al. ..... 405/302.3
4,230,370 A * 10/1980 Cartledge et al. ..... 405/302.3
4,251,168 A * 2/1981 Groetschel ..... 405/302.3
4,358,159 A 11/1982 Groetschel
4,379,660 A 4/1983 Groetschel
5,199,825 A * 4/1993 Travis ..... 405/302.3
5,277,520 A * 1/1994 Travis ..... 405/302.3
5,816,750 A 10/1998 Steffenino
6,863,476 B2 3/2005 Malkoski

* cited by examiner

*Primary Examiner* — Frederic L Lagman
(74) *Attorney, Agent, or Firm* — King & Schickli, PLLC

(57) ABSTRACT

A system for handling a roll of mesh for application to one or more faces of an underground mine passage includes a dispenser for supporting the roll of mesh for application to at least one face of the mine passage, as well as at least one arm for supporting the mesh adjacent to the face upon being dispensed from the dispenser. The arm is capable of flexing in providing this support to provide tension to the mesh during the application from the roll to the at least one face of the mine passage. The dispenser may include a cradle for dispensing the mesh from the roll. The cradle may include a base for supporting the roll of mesh and at least one laterally extendable support for supporting a first lateral side of the roll of mesh. Related methods are also disclosed.

25 Claims, 16 Drawing Sheets

MESH HANDLING SYSTEM FOR AN UNDERGROUND MINING MACHINE AND RELATED METHODS

TECHNICAL FIELD

The present invention relates to the mining arts and, more particularly, to a mesh handling system for an underground mining machine.

BACKGROUND OF THE INVENTION

Anchors or "bolts" provide primary support for one or more of the faces of a passage in an underground mine, such as the roof or overburden. In connection with the installation of these bolts, it is often necessary or desired to install a reticulated mesh or grid material along the corresponding face(s). The main role of mesh is to provide passive confinement, especially in locations where poor ground conditions prevail, preventing fragments of rock and coal from falling from the roof and ribs in the spacing between reinforcing bolts.

Under the current approach, this supplemental protection afforded by the grid or mesh is separately applied to the roof and ribs of the mine passage, and oftentimes completed manually as part of the bolting operation. Past proposals have been made in an effort to facilitate the application of grid or mesh through semi-automated approaches, such as by having a roll of mesh or grid in flexible form carried by a mining machine and applied during the advance to form the mine passage.

Despite such advances, the known approaches suffer from being relatively complex in nature, and generally do not obviate the continued need for significant operator involvement. Specifically, an operator must still be involved to a significant extent in helping to initially support and tension the grid material or mesh during installation, and must also take measures to ensure that the proper amount of tension is provided throughout the operation. These requirements for frequent manual intervention increase the man hours and thus limit the practical effectiveness and efficiency of the limited automation provided. Past approaches are also limited to applying the grid to only the roof, which then requires a separate manual application to the rib(s) if the supplemental protection afforded thereby is required.

Accordingly, a need is identified for an improved system for use in applying a grid or mesh to a face of a mine passage. As compared with past approaches, the system would be relatively simple in construction and inexpensive to implement. Yet, it would bring a significant level of advancement in terms of the savings in time and cost realized from its use. The result that follows from use of the system would be an overall increase in the efficiency of the mining operation.

SUMMARY OF THE INVENTION

In one aspect, this disclosure relates to a system for handling a roll of mesh for application to one or more faces of an underground mine passage, such as in association with a roof bolting operation performed by a roof bolter. The system comprises a dispenser for dispensing mesh from the roll for application to at least one face of the mine passage. The system further comprises at least one arm for supporting the mesh adjacent to the face upon being dispensed from the dispenser. The arm is capable of flexing to provide tension during the application of the mesh to the at least one face of the mine passage.

Preferably, the at least one flexible arm comprises a first flexible arm for supporting the mesh, and the system further includes a second flexible arm for supporting the mesh. The first and second flexible arms may extend in opposite directions for biasing the mesh in a direction transverse to a longitudinal direction of the mine passage, but also may be considered to extend in generally orthogonal directions. Most preferably, the end of the flexible arm is adapted for positioning in an opening in the mesh, and may be supported in a laterally extendable fashion by an automated temporary roof support associated with a mining machine.

The dispenser preferably comprises a cradle for receiving the roll of mesh to engage an outer surface thereof. The cradle may include at least one laterally extendable support for supporting a lateral side of the roll of mesh. Preferably, the cradle comprises an extendable support for supporting each lateral side of the roll of mesh.

Another related aspect of the disclosure pertains to an apparatus for handling a roll of mesh intended for application to one or more faces of a mine passage. The handling apparatus comprises a cradle for dispensing the mesh from the roll. The cradle comprises a base for supporting the roll of mesh and at least one laterally extendable support for supporting a first lateral side of the roll of mesh. Preferably, the cradle comprises at least one laterally extendable support for supporting each lateral side of the roll of mesh, and includes a base adapted for receiving a portion of the laterally extendable support in a telescoping fashion.

Still a further aspect of the disclosure relates to an apparatus for intended use in connection with a vehicle for providing temporary support for a face of a mine passage and facilitating the application of mesh to the face. The apparatus comprises a dispenser carried by the vehicle for dispensing the mesh from the roll for application to at least one face of the mine passage, as well as a support carried by the vehicle having a pad for selectively engaging and supporting the face of the mine passage. The support includes at least one laterally extendable arm for applying tension to the mesh.

Preferably, the laterally extendable arm is capable of flexing in an amount sufficient to provide tension to the mesh. The support may include first and second laterally extendable arms, which may project in opposite or orthogonal directions. Still more preferably, the support comprises a transverse beam having at least one tubular end for receiving the laterally extendable arm in a telescoping fashion.

Yet a further aspect of the disclosure relates to a related method of providing supplemental support for a roof and at least one rib of an underground mine passage having a width. The method comprises dispensing mesh having a width greater than the width of the mine passage from a dispenser secured to a vehicle. The method further includes securing the mesh in the passage to cover the roof and at least one rib.

Preferably, the method includes the step of laterally expanding the dispenser to support at least one side of the roll of mesh. The method may further include providing support for the mesh adjacent to the interface between the roof and rib. Preferably, the step of providing support comprises engaging the mesh with at least one flexible arm carried by the vehicle. Still further, the method includes the step of anchoring the mesh to the rib.

DETAILED DESCRIPTION OF THE INVENTION

Figure 1A:
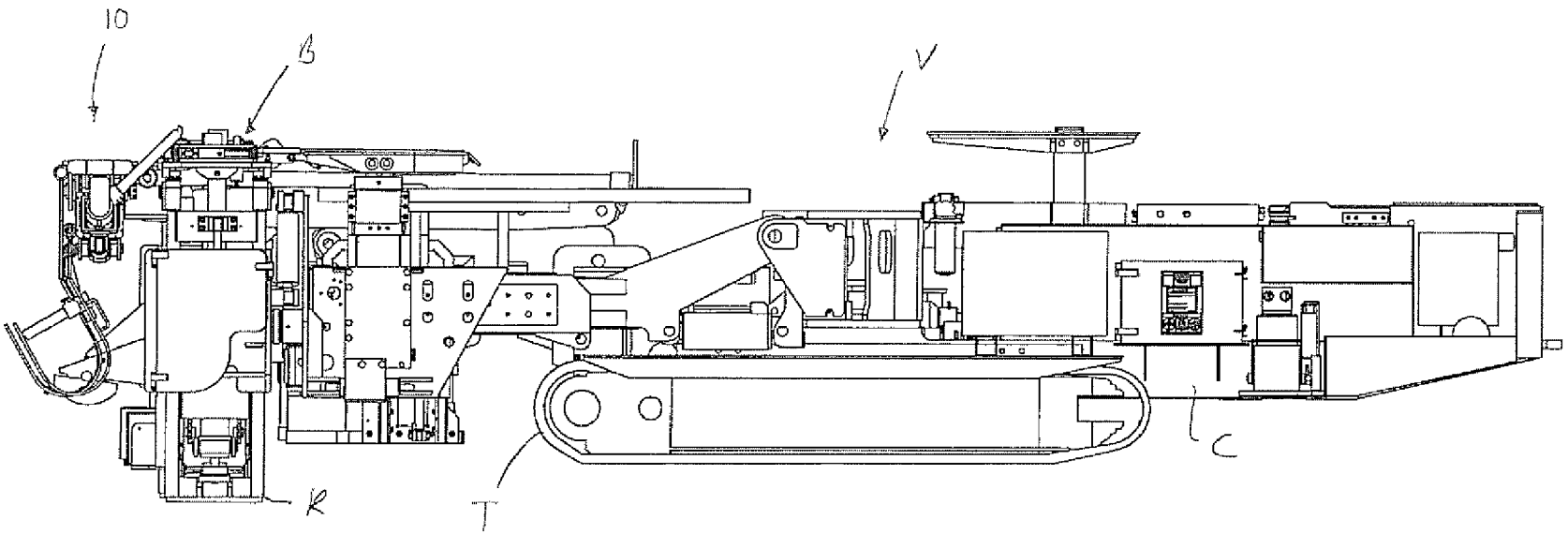
FIGS. 1*a*, 1*b*, 1*c* and 1*d* are side, front, and top views of a mining vehicle incorporating the mesh handling system.
Figure 1B:
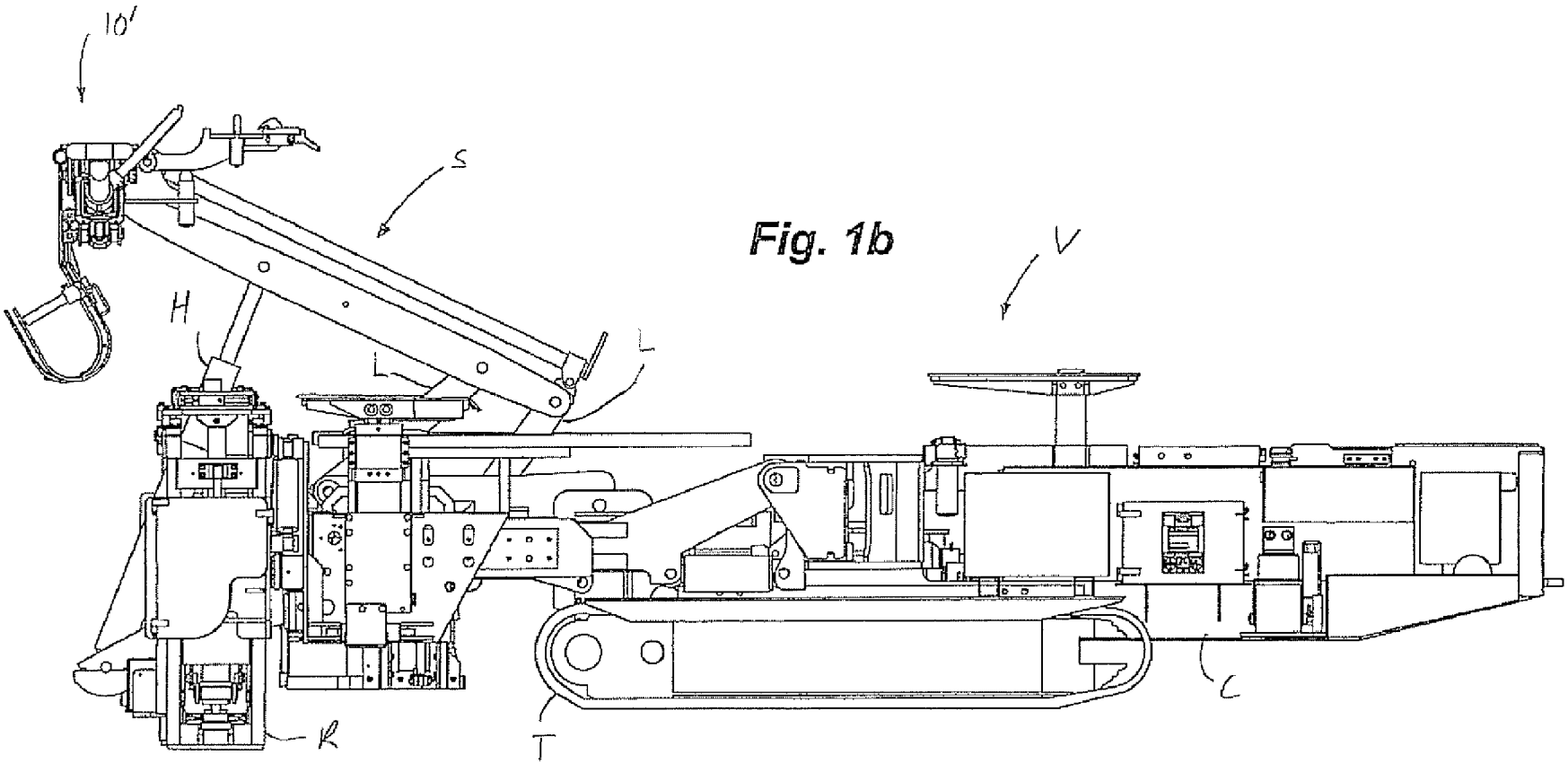

Reference is now made to FIGS. 1*a* and 1*b*, which reflect side views of a mining machine incorporating a system 10 for handling mesh during its application to a face of an underground mine passage. The machine in the illustrated case takes the preferred form of a vehicle V having a chassis C to which ground-engaging motive devices are attached. Preferably, these devices comprise crawler tracks T for tramming about the underground mine passage.

Figure 1C:
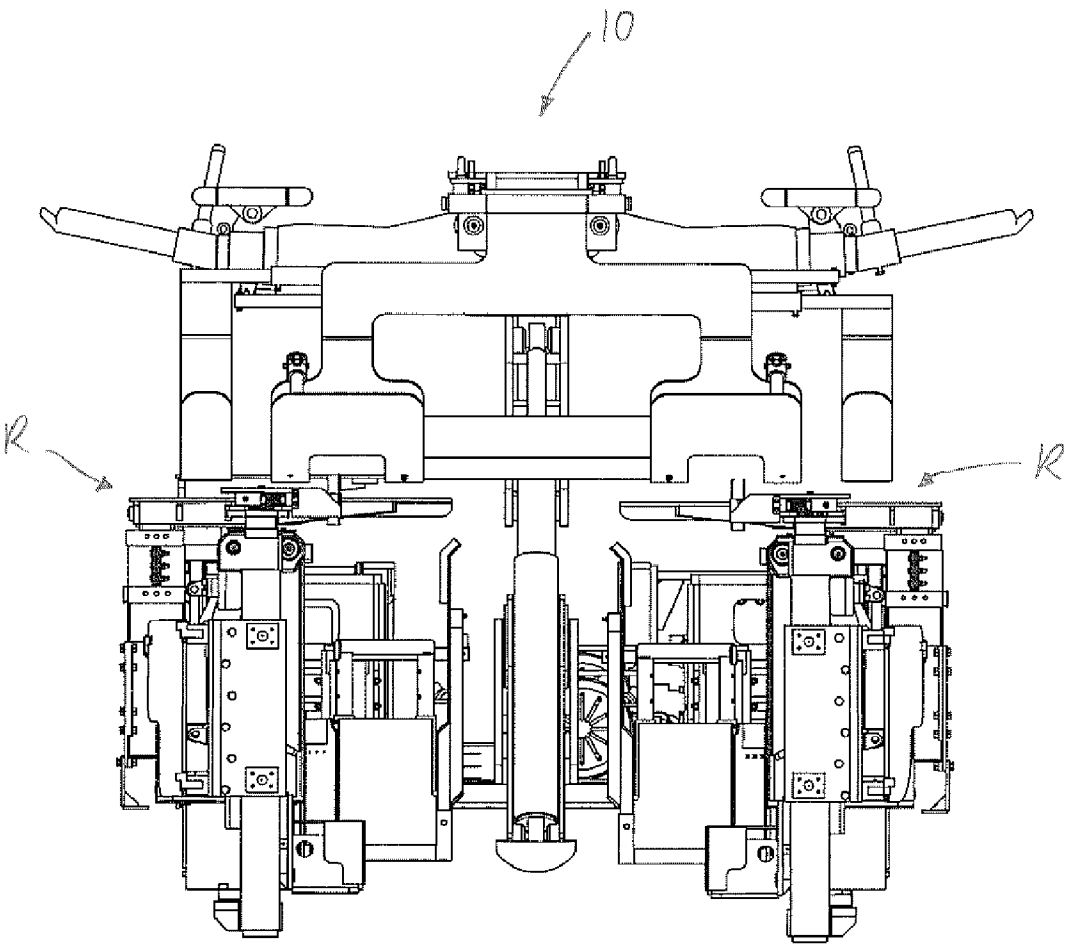
Figure 1D:
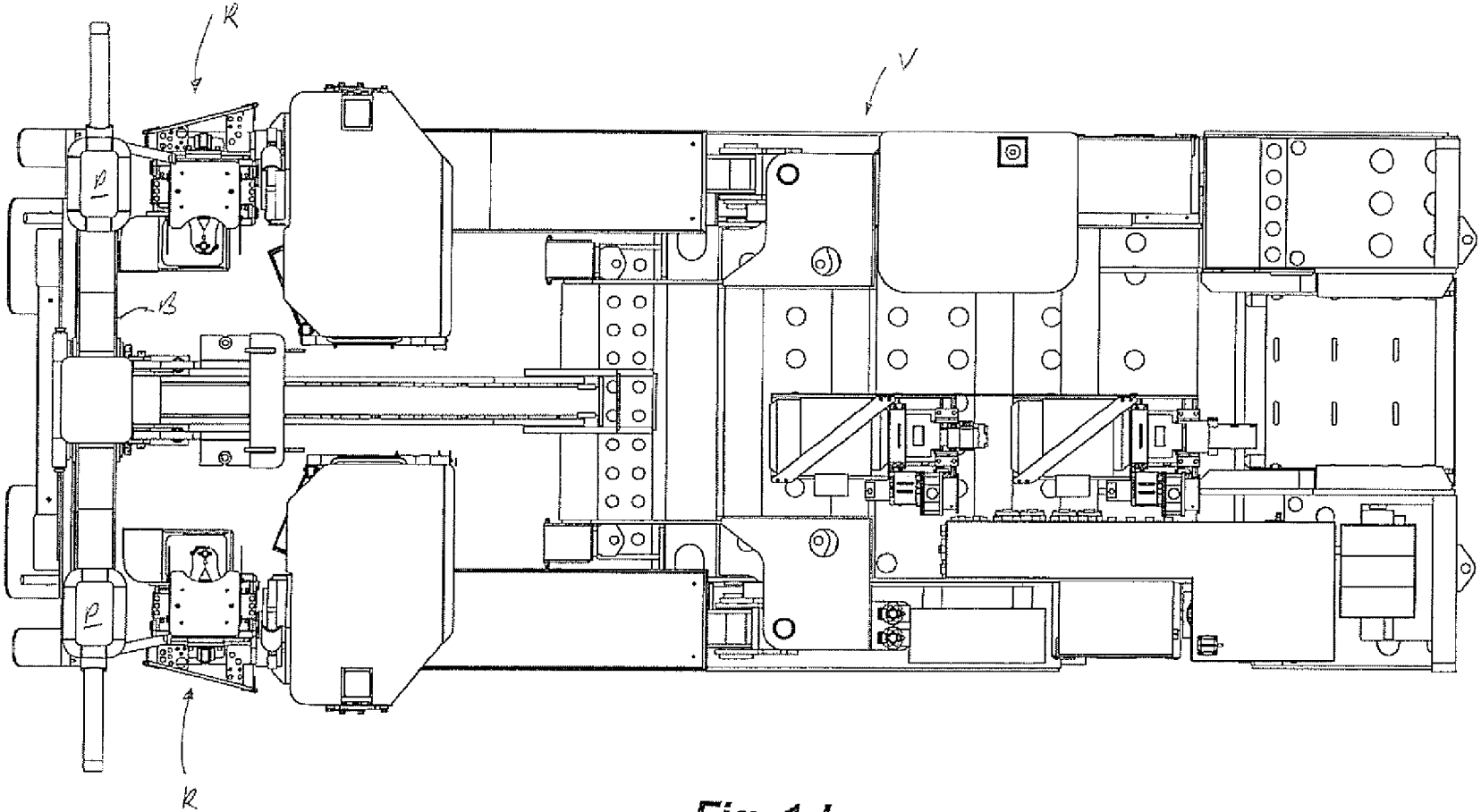

Adjacent the front or leading edge, the vehicle V includes a bolting module B including drilling and bolting rigs R (see FIGS. 1*c* and 1*d*) for applying bolts to one or more faces of the mine passage, such as the roof or ribs, as well as an automated support S for selectively engaging the roof to provide support while the bolts are being installed. For this purpose, a suitable lifting device is provided (see FIG. 2), which may comprise a hydraulic cylinder H and suitable linkages L and may facilitate lifting of the mesh handling system (note position 10' in FIG. 1*b*). However, it should be appreciated that the use of the mesh handling system 10 is not limited to the specific type of roof bolter shown as the exemplary vehicle V, and may have applicability on other types of vehicles use in mining applications, including continuous miners, tractors, haulers, or the like.

Figure 2:
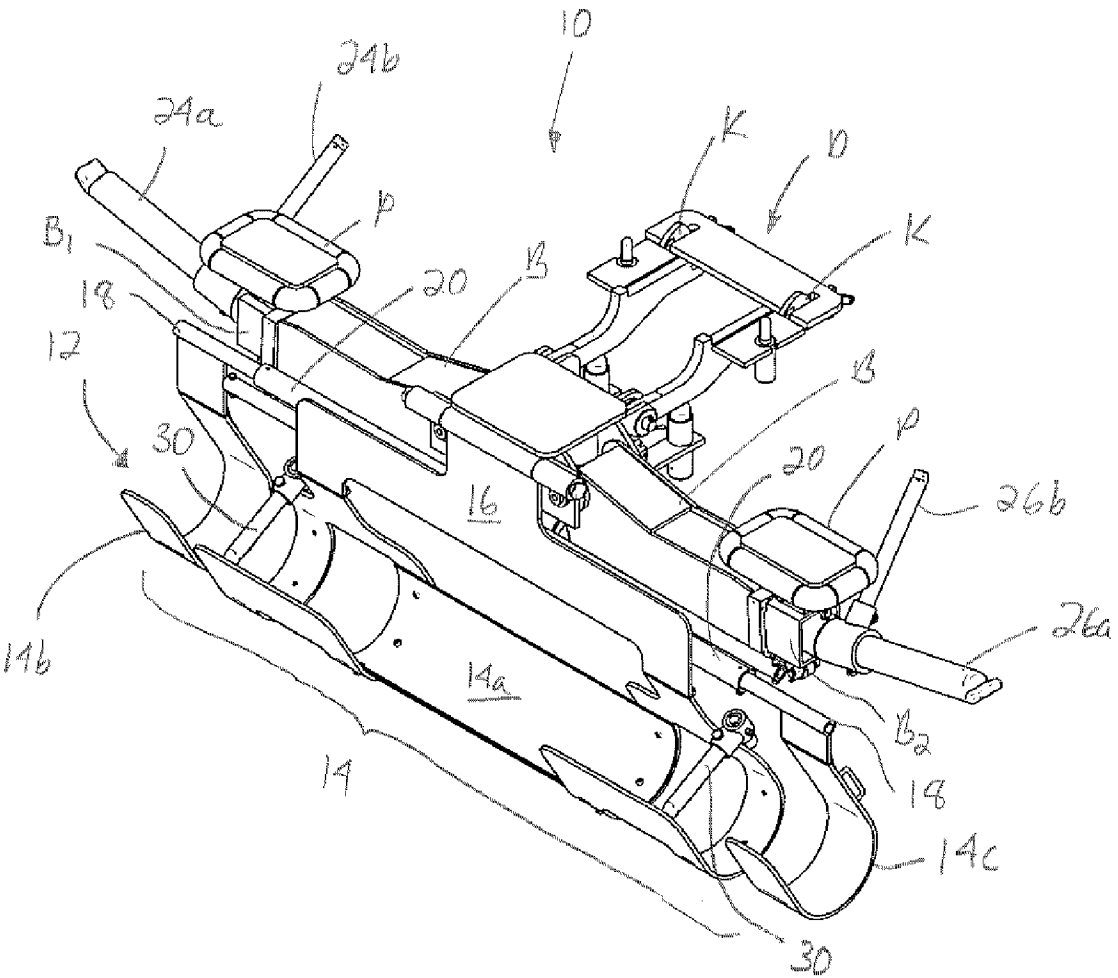
FIG. 2 is a perspective view of the mesh handling system apart from the vehicle.

Turning to FIG. 2, the mesh handling system 10 of the preferred embodiment is shown apart from the vehicle V to provide a better illustration of the major components involved. One such component comprises a dispenser 12 for dispensing the mesh. In the illustrated embodiment, the dispenser 12 includes a cradle 14 designed to provide full support for the mesh in roll form. Preferably, the cradle 14 comprises a main portion or base 14*a* for supporting an intermediate portion of the mesh roll, as well as at least one and preferably two side portions 14*b*, 14*c* for supporting the opposite lateral or side ends of the roll. As shown, the intermediate portion 14*a* and side portions 14*b*, 14*c* may be generally U-shaped along a lower portion to cradle and support the roll, while leaving an open top to allow a free end of the mesh to extend from the roll outwardly toward the corresponding face(s) of the mine passage.

The dispenser 12 also includes a connector portion 16 that is used to secure it to the front or leading portion of the vehicle V. In the preferred embodiment, the securing is provided along the main beam B of the automated temporary roof support S. In this manner, the mesh is dispensed from the leading end of the vehicle V when traveling, as is desirable.

Understandably, the width of the mesh roll used may vary depending on the width of the involved face of the mine passage. To adapt for and accommodate these changes in width, one and preferably both of the side portions 14*b*, 14*c* of the cradle 14 are arranged to move laterally relative to the base 14*a*. In the preferred embodiment shown, this is accomplished by providing each side portion 14*b*, 14*c* of the cradle 14 with a support 18 that is slidably mounted to telescope within a corresponding sleeve 20 associated with the cradle base 14*a*. Hence, when it is desired to extend the width of the cradle 14, one or both side portions 14*b*, 14*c* may be manually moved outwardly, such as to correspond to the width of the mesh roll (note extended positions 14*b*' and 14*c*' in FIG. 4*c*). These portions 14*b*, 14*c* may then be retracted when not in use (such as when tramming the vehicle V to a different section of the mine without the mesh roll in place on the cradle 14).

Given the capability of being rolled, the mesh involved here comprises a relatively flexible, thin, reticulated sheet of polymeric material, which is thus generally not self-supporting when unrolled. In the confines of the underground mine passage, this flexibility combined with the relative width of the mesh when unrolled (which can be 20-30 feet or more), makes it desirable to support the mesh prior to and during application to the face of the mine passage. Otherwise, the mesh can become loose or bunched up, which aside from being unsightly makes it largely ineffective in providing the desired supplemental support for the face.

Accordingly, with continued reference to FIGS. 1*a* and 1*b*, the handling system 10 also includes one or more structures for supporting the mesh once dispensed from the roll adjacent to the corresponding face(s) of the mine passage, while at the same time helping to provide sufficient tension in both the forward and transverse directions to prevent the mesh from sagging to an unacceptable degree. In the illustrated embodiment, these support structures comprise at least one, and preferably two pairs of arms 24*a*, 24*b* and 26*a*, 26*b* positioned along each side of the vehicle V, above and adjacent the exit opening of the cradle 14. Specifically, the first pair of arms 24*a*, 24*b* are positioned in a dual holder 24*c* received in a telescoping fashion in one end of the tubular, laterally extendable beam $B_1$ forming part of the automated temporary roof support S, while the holder 26*e* for the second pair of arms 26*a*, 26*b* is positioned in the end of the opposite laterally extendable beam $B_2$.

Figure 4A:
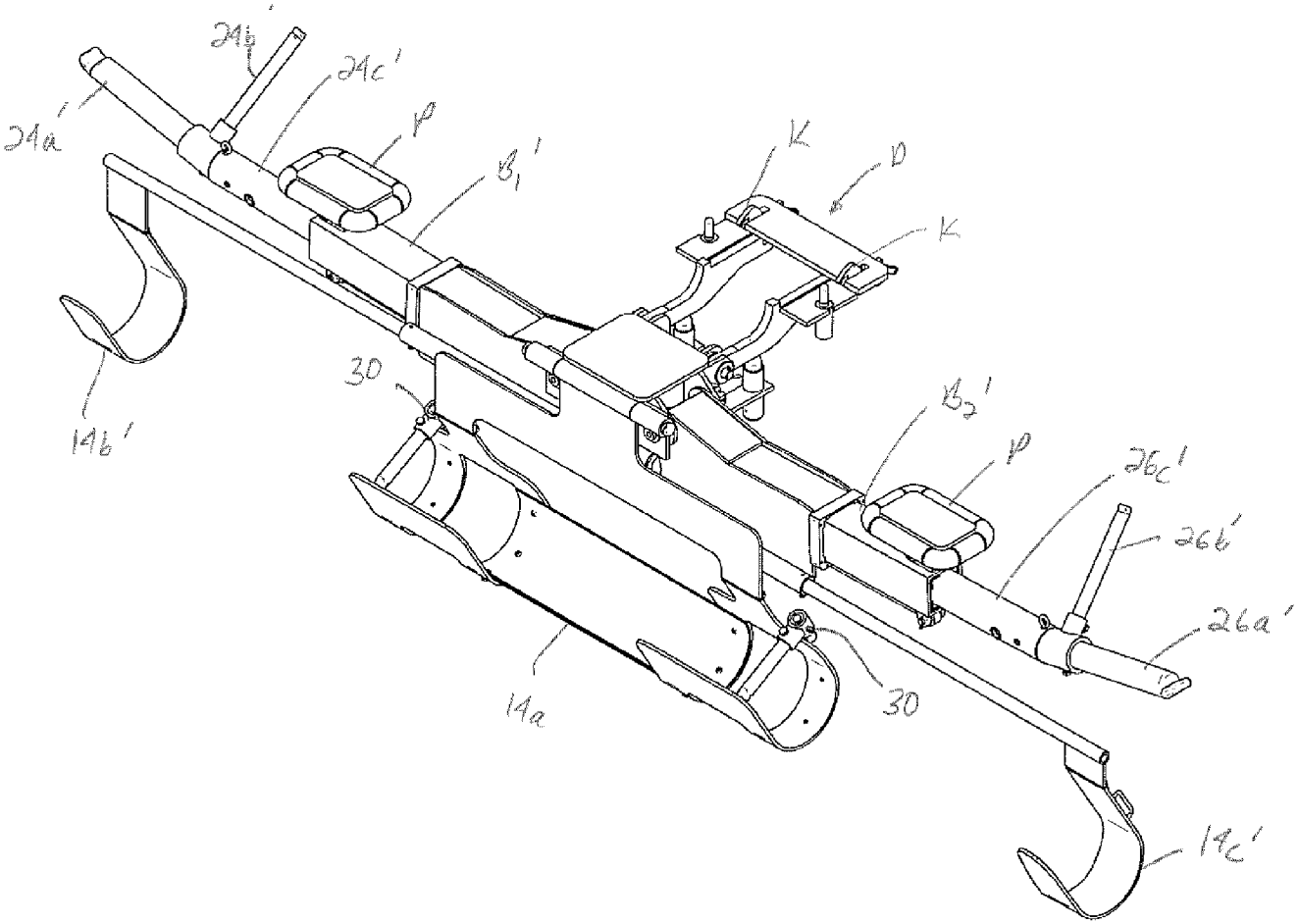
FIGS. 4*a*, 4*b*, and 4*c* are perspective, top, and front views of the mesh handling system in an operative condition for installing mesh on the face of a mine passage.
Figure 4B:
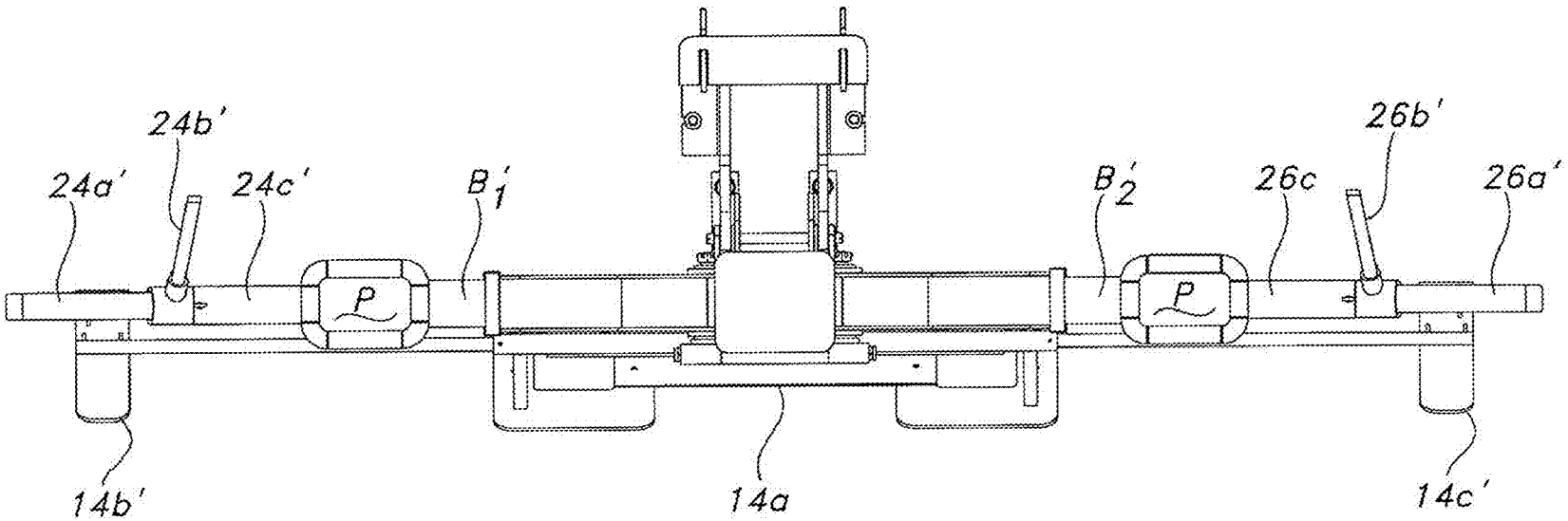

As should be appreciated from FIG. 2, these beams $B_1$, $B_2$ carry and support outer pads P for engaging the roof of the mine passage when the support S is extended to the working position. Preferably, the beams $B_1$, $B_2$, are laterally extendable independently of the arms 24*a*, 24*b*; 26*a*, 26*b*. This may be accomplished using independent hydraulic cylinders to provide the motivating force for the extension (note extended positions 24*a*', 24*b*' and 26*a*', 26*b*' in FIGS. 4*a*-4*b*).

Figure 3C:
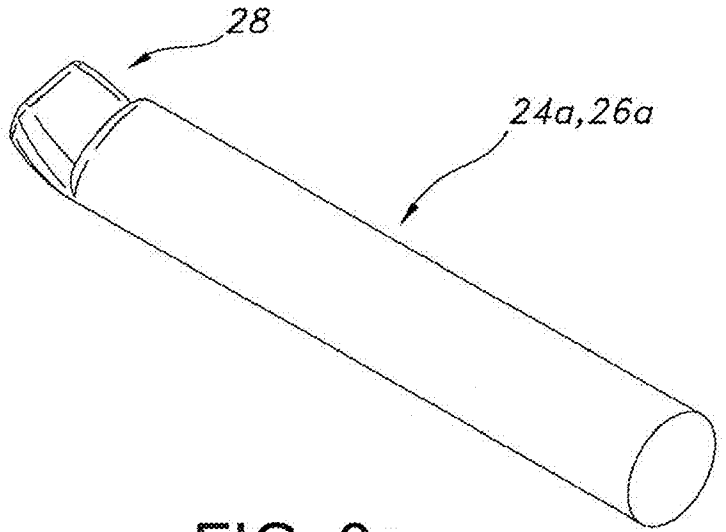
FIGS. 3*a*, 3*b*, and 3*c* are top, side, and perspective views of a flexible arm for use in connection with the mesh handling system.
Figure 3A:
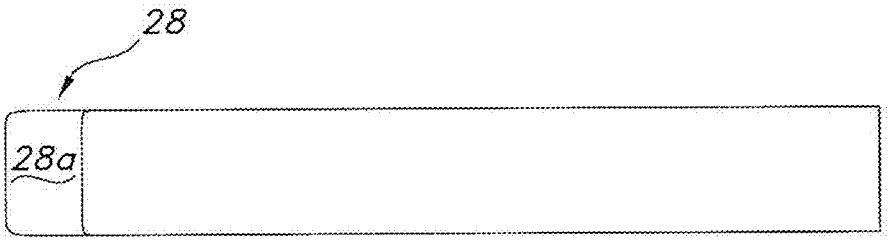
Figure 3B:
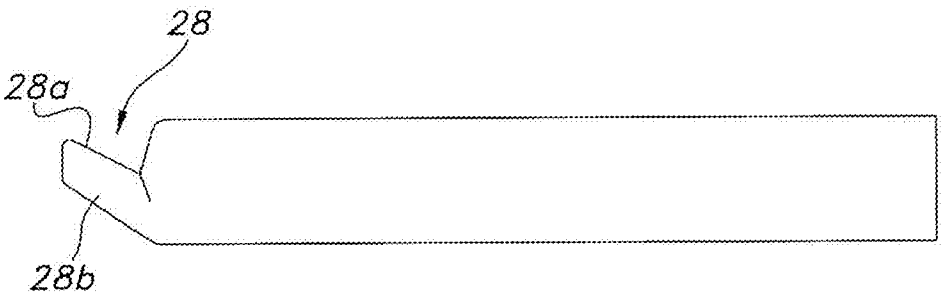

For reasons that will be further understood upon reviewing the description that follows, the arms 24*a*, 24*b* and 26*a*, 26*b* are preferably elongated rods formed of a relatively flexible, yet durable material, such as polyurethane. As perhaps best shown in FIGS. 3*a*-3*c*, each arm 24*a*, 24*b*; 26*a*, 26*b* further includes a notch 28 at one end. This notch 28 creates a relatively flat, shelf-like surface 28*a* for engaging and supporting a transverse web of the mesh, and also defines an undersized end adapted for positioning in a corresponding opening. Preferably, this undersized end takes the form of an upwardly projecting finger 28*b* thinner in the vertical width dimension and thus of enhanced flexibility relative to the oversized portion of the arms 24*a*, 24*b* and 26*a*, 26*b*.

Figure 2A:
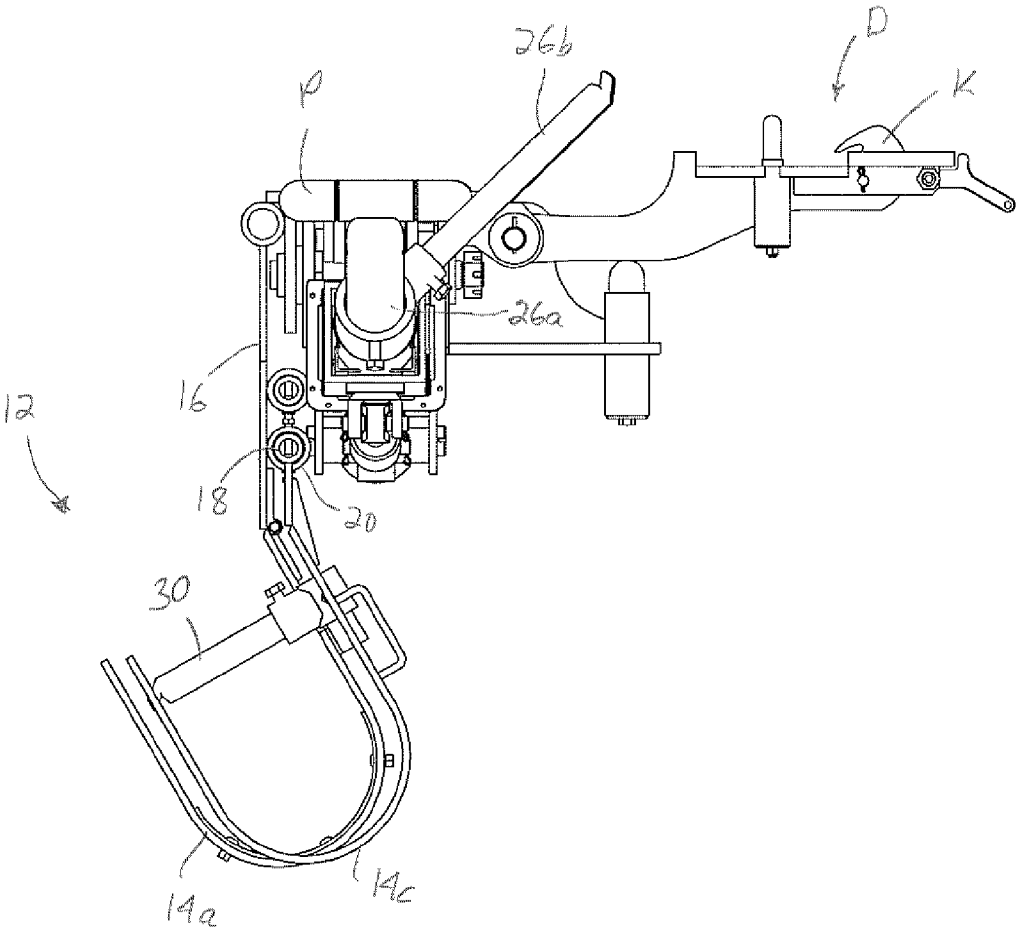
FIGS. 2*a*, 2*b* and 2*c* are side, front, and top views of the mesh handling system of FIG. 2.
Figure 2B:
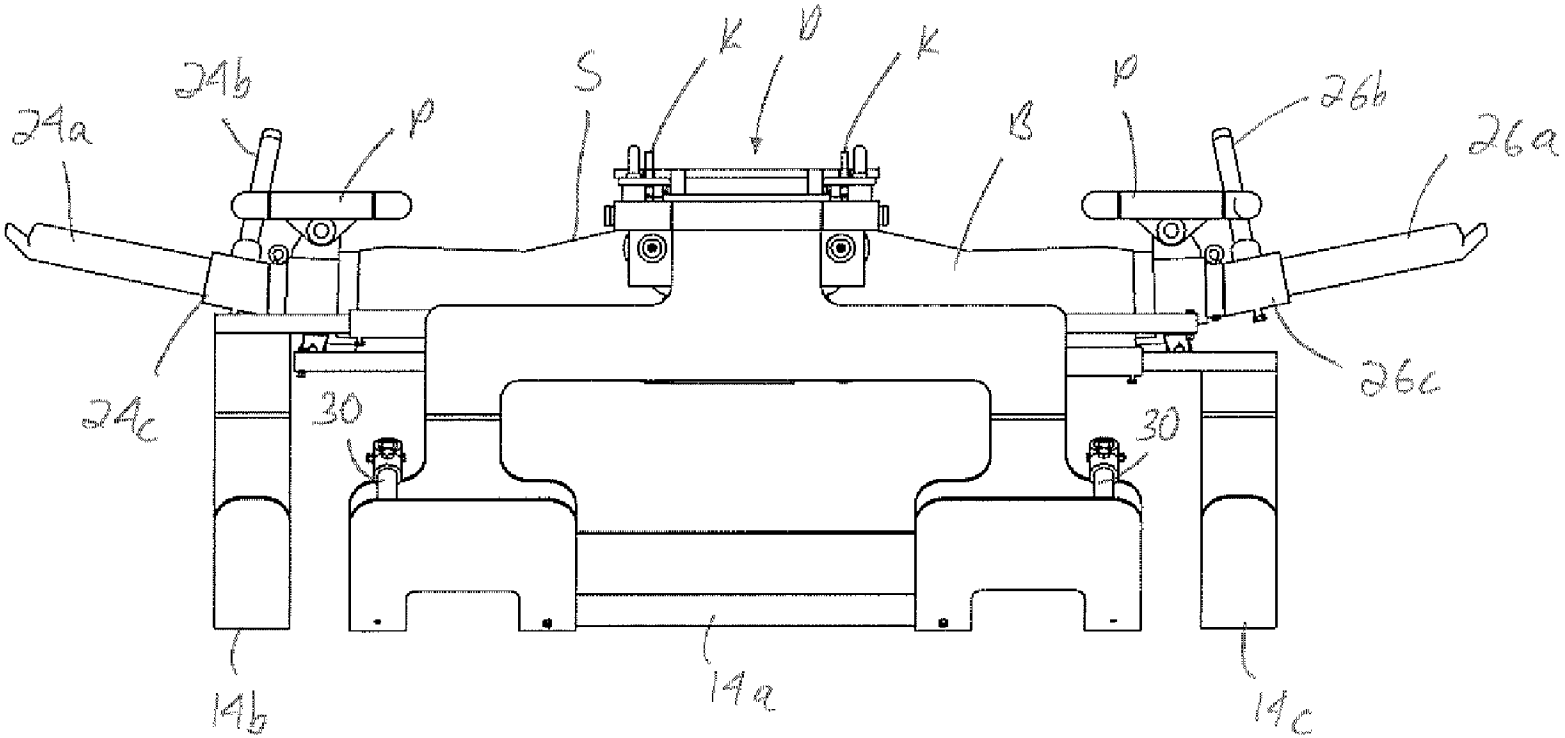
Figure 2C:
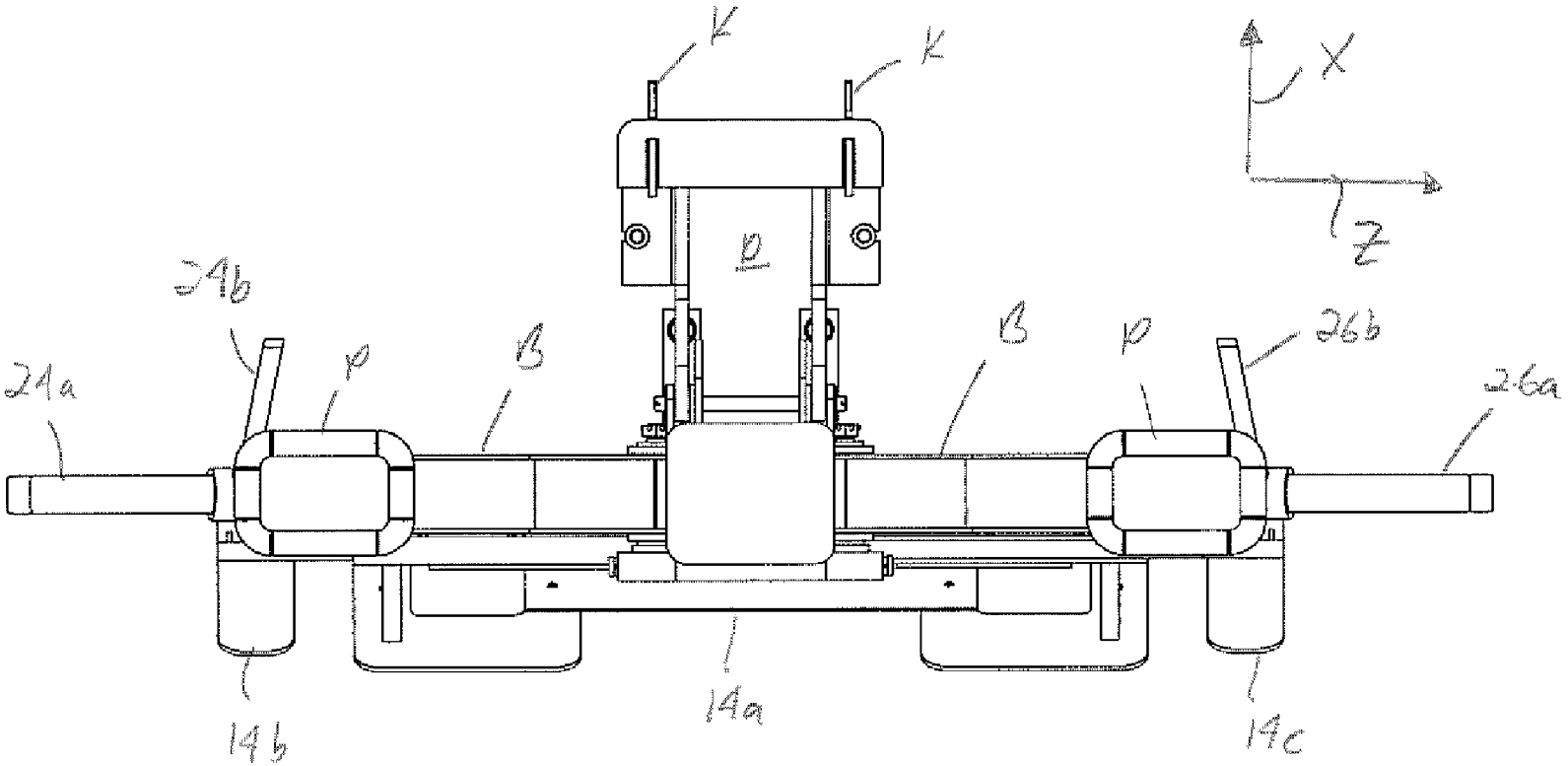

Turning back to FIG. 2*c*, it can be understood that two of the arms 24*a*, 26*a* project in generally opposite directions, and would normally extend in a direction generally transverse to the direction of vehicle travel. In contrast, the other arms 24*b*, 26*b* generally extend rearwardly in a direction aligned with the direction of vehicle travel, but are also inclined relative to a horizontal plane (see FIG. 2*a*) as the result of the positioning of the corresponding receiver in the associated holder 24*c*, 26*c*. Despite this inclination, the corresponding pairs of arms 24*a*, 24*b* and 26*a*, 26*b* thus extend in generally orthogonal directions (namely, the travel direction X and the lateral direction Z).

Figure 4C:
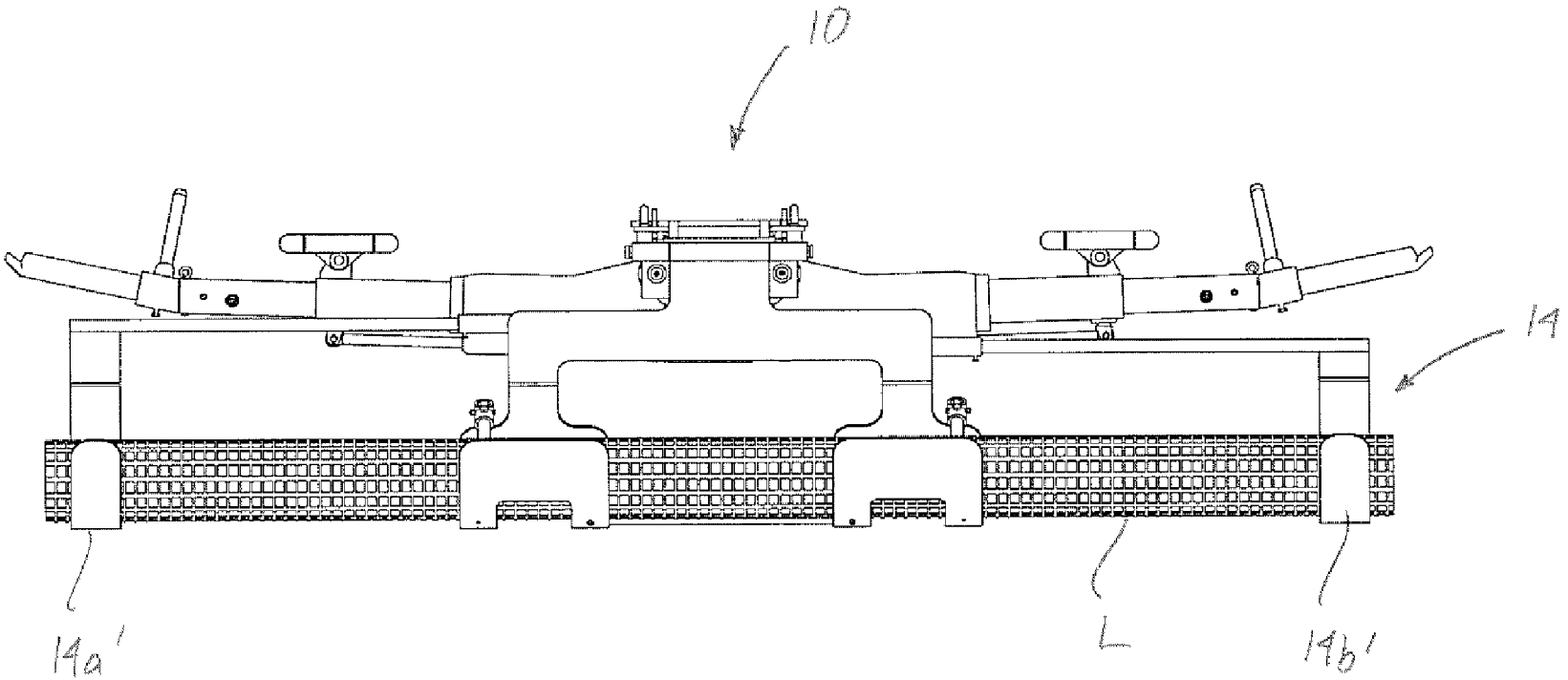

With the foregoing understanding of the basic components of the system 10, the following description of one possible method of installation is now provided, with further reference to FIGS. 5-8. On or before positioning the vehicle V in the mine passage in need of support, a roll L of mesh of a suitable width is provided on the cradle 14, as shown in FIG. 4*c*. The side portions 14*b*, 14*c* may be extended as necessary to support the opposing lateral ends of the mesh roll.

Figure 5:
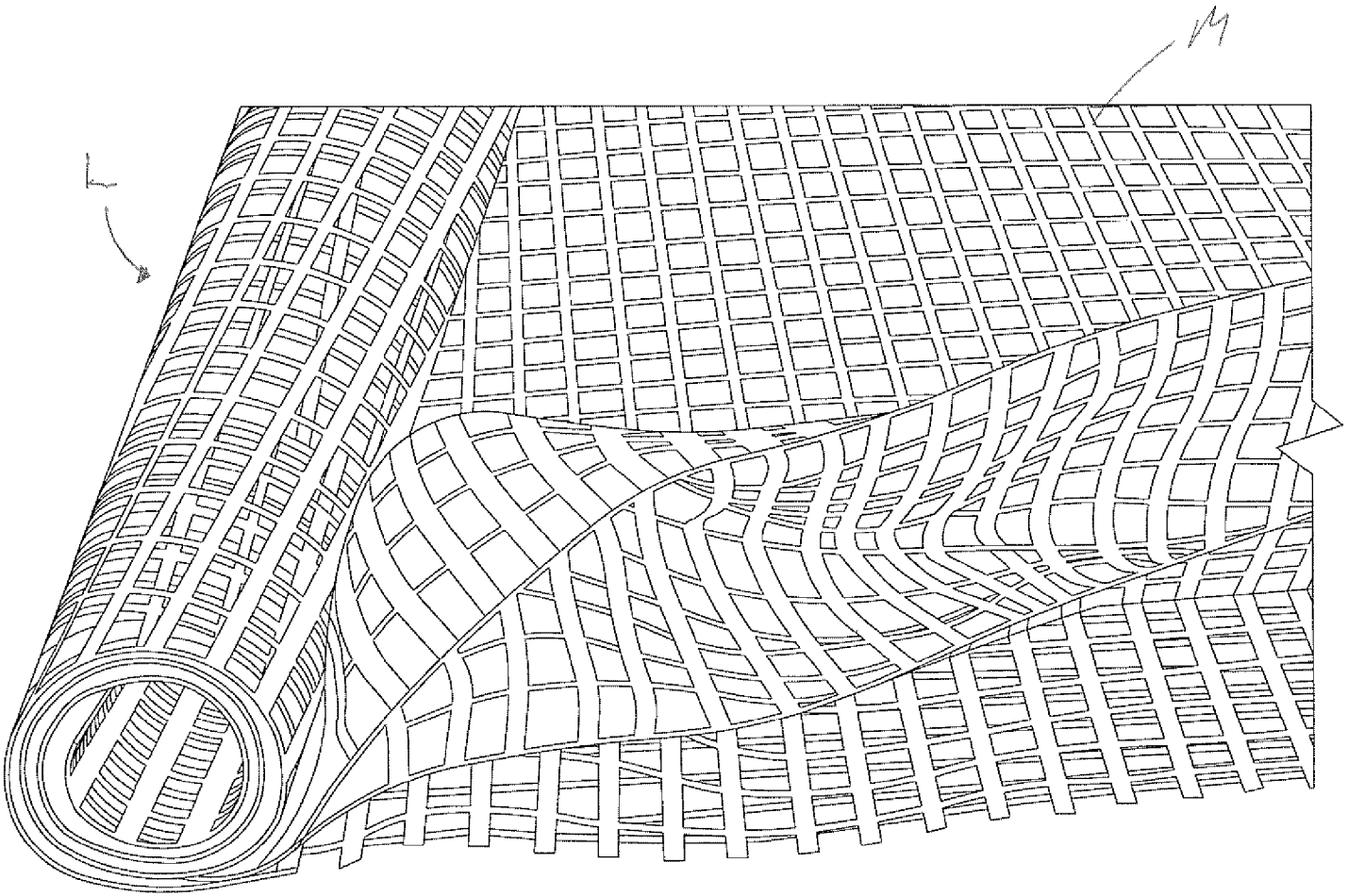
FIG. 5 is a perspective view illustrating one manner of folding a roll of mesh.
Figure 6A:
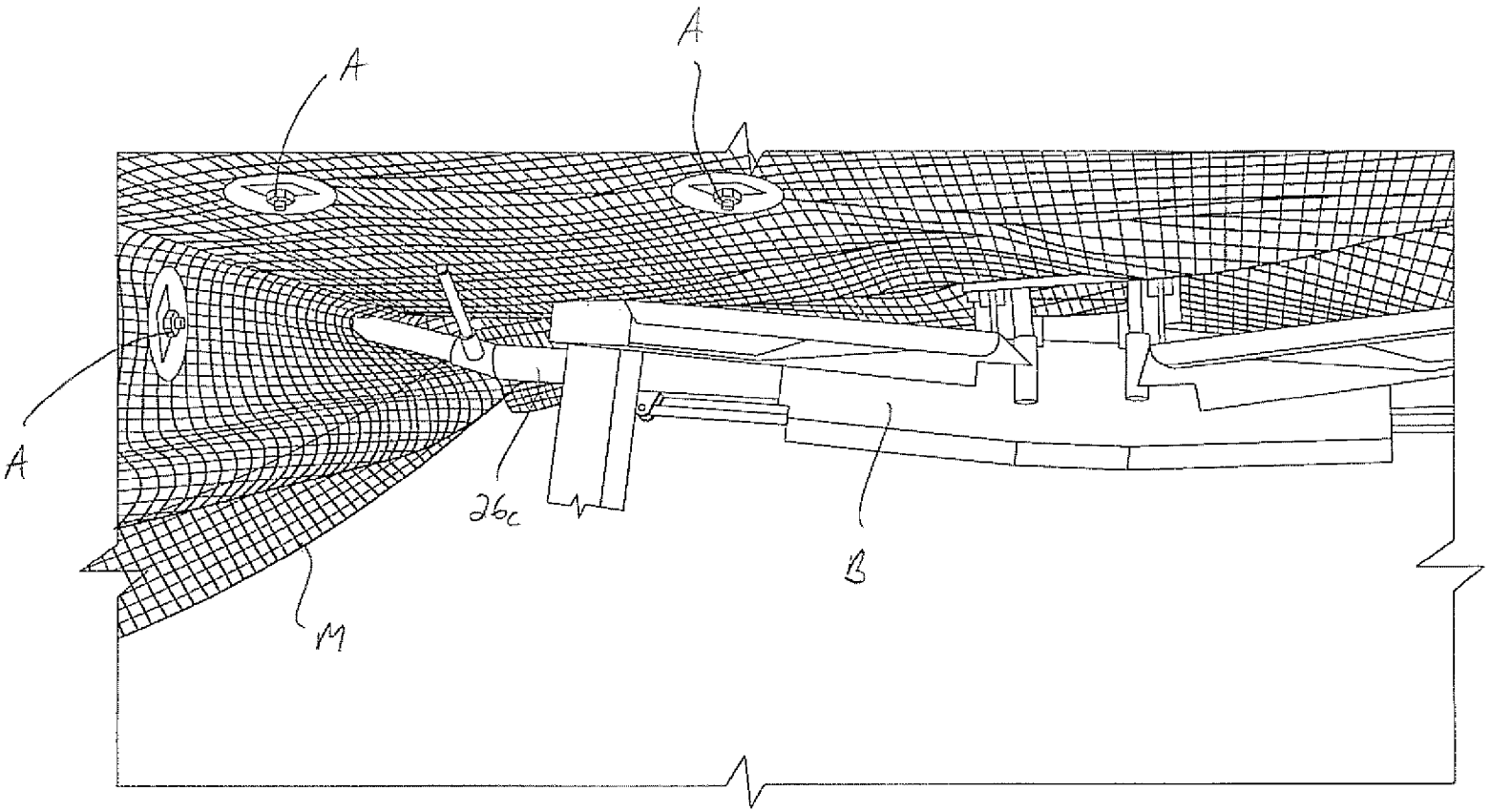
FIG. 6*a* is a partially cross-sectional end view of the installation of mesh in a mine passage using the mesh handling system.
Figure 6B:
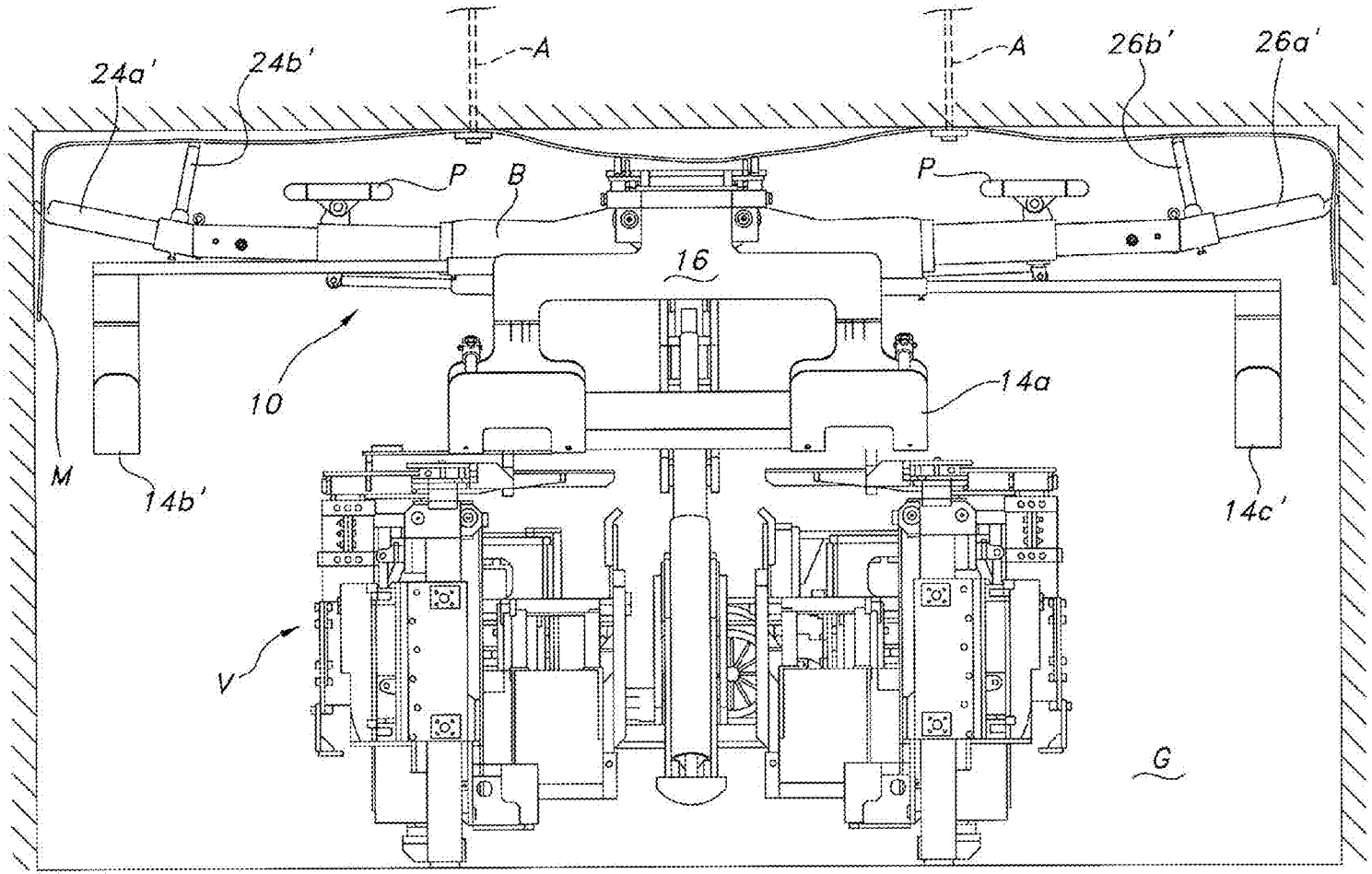
FIG. 6*b* is a partially cutaway perspective view illustrating the installation of mesh in a mine passage using the mesh handling system.

In cases where mesh is applied only the overhead surface or roof of the mine passage, this roll L may correspond in width to the approximate width of the cut that formed the passage. However, the mesh is preferably oversized in width relative to the width of the passage for purposes of being simultaneously applied to multiple faces (such as, for example, the roof and one or more of the ribs). To accommodate this oversized width, the mesh material is preferably folded prior to rolling in order for the roll L to have a width less than the width of the passage. For example, as shown in FIG. 5, the mesh M may be overlapped or pleated in a lateral fashion, along at least one side prior to being placed in the form of a roll L. While this pre-folding technique has been found to be particularly effective, it should be appreciated that the use of other types of folding arrangements may also be suitable.

Once this oversized, but partially folded and rolled mesh is positioned in the cradle 14, the leading or free end is initially drawn over the spaced side and center pads P of the temporary roof support S. Preferably, the leading end of the mesh is temporarily held in this position by a mechanical structure, such as one or more hooks. In the illustrated embodiment, the temporary roof support S carries an independent device D used for applying a sheet of rigid grid material (such as steel mesh) to the roof, which may include suitable hooks K capable of initially latching onto the leading free end of the mesh extending over the pads P.

Given the oversized nature of the mesh relative to the width of the mine passage, it should be appreciated that it not only spans the roof or ceiling of the passage, but also partially covers one or both of the adjacent ribs in a curtain-like fashion. Added support for the leading end and lateral sides of the mesh adjacent the roof and ribs is provided by the arms 24*a*, 24*b* and 26*a*, 26*b*. Specifically, the side arms 24*a*, 26*a* are laterally extended and positioned such that the associated fingers 28*b* extend into corresponding openings in the mesh and provide support therefor. As mentioned above, these arms 24*a*, 26*a* are substantially flexible in nature, and thus may bend, initially in the vertical direction Y (see FIG. 7) as a result of engaging and supporting the mesh M. This bending creates a biasing force that helps to tension the mesh, including in the transverse direction or laterally.

At the same time, the arms 24*b*, 26*b* engage the unpinned forward or leading end of the mesh adjacent to the roof in a similar fashion, and thus provide a level of tensioning aligned with the direction of vehicle movement. The combined tensioning and spreading afforded by the arms 24*a*, 24*b* and 26*a*, 26*b* helps initially to maintain the mesh in a substantially taut state, ready for being secured to the corresponding face(s) of the mine passage by the selected anchors.

With the mesh M in this initial position, the beam B of the roof support S may be raised to engage the pads P with the roof and provide the desired temporary support. As should be appreciated from FIG. 6*a*, this engagement also presses the intervening mesh M against the face of the ceiling, and thus helps to secure it in place. The selected bolts or anchors A may then be placed in the conventional manner to provide the desired support for the roof and ribs, with the corresponding plates or like structures serving to capture and fix the mesh in place. Preferably, buffers such as felt pads are used at the interfaces between any plate associated with the bolts or anchors A and the mesh M to prevent undesirable tearing during installation.

Once the mesh M is initially fixed, the temporary support S may then be disengaged from the roof (e.g., lowered), and the vehicle V may then move or tram forward to the desired location for the next series or row of bolts (usually, about 4-5 feet). As the vehicle V moves, additional mesh is unrolled from the dispenser 12 and, in the case of pre-folding, simultaneously unfurls laterally along the sides to assume the full width. However, the laterally projecting arms 24*a*, 26*a* remain in the extended condition to engage the lateral sides of the initially unfurled, unrolled mesh, and thus continue to provide full support for it adjacent the interface between the roof and rib. Similarly, the arms 24*b*, 26*b* support the mesh intermediate of the lateral sides. In view of the inherent flexibility, the arms 24*a*, 24*b* and 26*a*, 26*b* can bend and automatically continue to apply a suitable amount of tension to the mesh M in the corresponding direction as the vehicle V advances.

Figure 8:
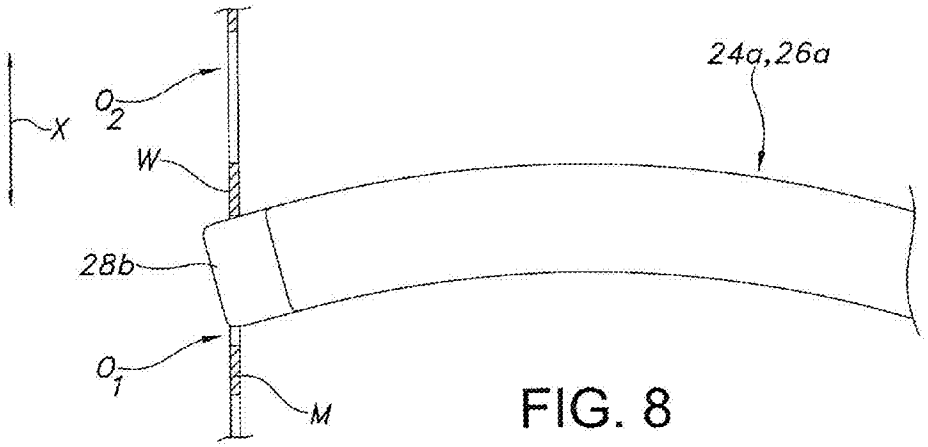
FIGS. 7 and 8 are top and side views schematically illustrating the possible functioning of the flexible arms during the installation of the mesh.
Figure 7:
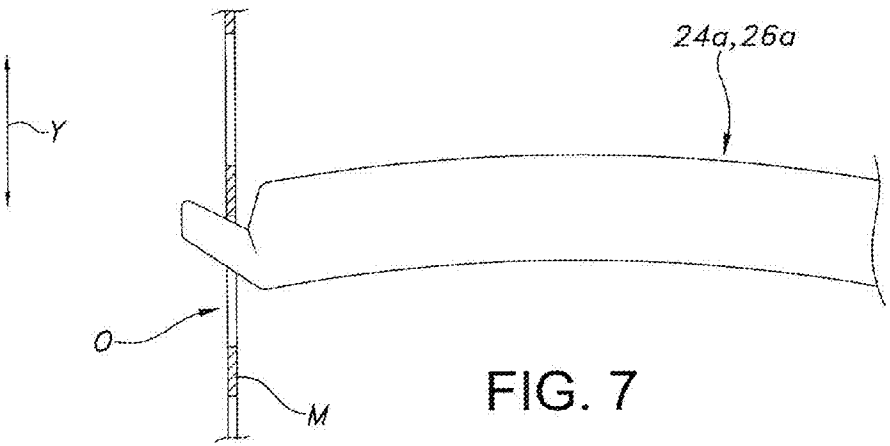

At the point where the movement of the vehicle V in the forward direction overcomes the biasing force provided, the arms 24*a*, 26*a* "backbend" in the travel (or longitudinal) direction X as the result of the continued engagement with the corresponding web W of the mesh M (see, e.g., FIG. 8). Eventually, this bending occurs to the extent that the undersized end or finger 28*b* of each arm 24*a*, 26*a* releases the corresponding forward web W at the leading end of a first opening $O_1$ and skips into the next-adjacent opening $O_2$ in the mesh M, thereby continuing to provide the desired tension in an essentially automatic fashion. Skipping may also occur in the vertical direction Y to allow the finger 28*b* to extend into the next-adjacent opening. As should be appreciated, this skipping action may continue in an automatic fashion as the vehicle V moves forward in the travel direction X until the mesh M is completely unrolled and installed (see FIG. 6*b*, noting mesh M completely covering roof or ceiling and partially covering the vertical sidewalls or ribs of the mine passage G).

A similar progression may occur along the mesh M once dispensed from the dispenser 12 with the rearwardly directed arms 24*b*, 26*b*, if present. However, the tensioning function may be somewhat less important at this location, since the previous pinning of the mesh (or the retention by hooks K) combined with the resistive force created by the weight of the roll L in the dispenser 12 will inherently provide some level of tension to the unfurled intermediate portion of the mesh.

In this regard, it may be desirable to associate an optional keeper with the open end of the cradle 14 to provide a hold-down function for the roll L of mesh, especially during unrolling. As shown in FIG. 2, this keeper may comprise a pair of flexible arms 30, which may be similar in construction to arms 24*a*, 24*b* and 26*a*, 26*b*. The arms 30 may be fixed to the base 14*a* and extend over the open end to thus provide the desired level of force to help retain the mesh within the cradle 14, but without interfering with the desired dispensing function. The ends of these arms 30 may also be adapted to fit within openings in the mesh as it initially becomes unrolled, and thus perform the skipping function described and thus serve to help in providing added tension during the payout of the mesh from the dispenser 12.

Successive rows of bolts or anchors may be installed by repeating the above-described sequence, which full and reliable support provided by the arms 24*a*, 24*b* and 26*a*, 26*b* in the manner described. Advantageously, this not only simplifies the application of the mesh by avoiding the need for any significant operator intervention, but also results in the mesh being reliably applied in an evenhanded manner as the result of the constant and correct amount of tension being manually applied, including as the associated vehicle V advances along the passage. In cases where the mesh width exceeds that of the width of the mine passage, such as through folding, the present system 10 further reliably allows for the mesh to be applied to multiple faces of the mine passage, such as the roof and one or both ribs, without any significant adjustment.

The use of the disclosed dispenser 12 in the form of a cradle 14 avoids the need for independently supporting the mesh roll L for rotation, such as about a fixed spindle or the like, which greatly reduces the amount of time associated with loading the mesh into the cradle. Also, the frictional engagement between the roll L and the inside curved surfaces of main and side portions 14*a*-14*c* of the cradle 14 helps to prevent the mesh from sagging to any significant degree upon being paid out from the dispenser 12. This type of arrangement further avoids the need for complicated clutches, take-up motors, or the like for applying an appropriate level of tension to prevent unraveling of the mesh in the travel direction. A significant reduction in cost and complexity results, which are key considerations given the conditions under which the machine is operated in an underground mine, as well as the consequences of downtime in terms of making the repair underground as may be necessary to allow the mining operation to proceed.

As should be appreciated, it is also possible to use this type of system 10 when applying mesh only to the roof of the mine passage. In this case, the arms 24*a*, 26*a* may provide a similar support and temporary holding function along the lateral sides. Likewise, the rearwardly projecting arms 24*b*, 26*b* provide similar support and tensioning for the mesh M unrolled in a direction opposite to the travel direction.

The flexible material used in the arms 24*a*, 24*b* and 26*a*, 26*b*, as well as possibly for the keepers 30, preferably comprises polyurethane having a durometer (Shore A) hardness of about 50 and, most preferably a durometer (Shore A) hardness of about 60. In the preferred embodiment, the exposed length of the arm made of this material and falling within this hardness range is estimated to be approximately 22-24 inches to provide the desired bending function(s) to tension the mesh followed by the desired release to maintain the tension in a substantially evenhanded manner, with about 4-6 inches of each arm retained in the corresponding receiver associated with the holder 24*a* 26*c*. However, it should be appreciated that the particular approach may vary depending on the particular type of mesh used, as well as the relative dimensions of the particular vehicle and size of the passage for which the corresponding supplemental protection is desired.

Also, in the illustrated embodiment, the connector portion 16 is pivotally mounted to the vehicle V. This is done to allow the dispenser 12 to hang freely in the normal operative position. However, in situations where the vehicle V advances to a point where the front end is adjacent to a vertical face at the end of a mine passage, this pivoting potentially allows the dispenser 12 to move rearwardly without being damaged, and without compromising the continued ability of the mesh to remain supported in the intended manner by the arms 24*a*, 24*b*; 26*a*, 26*b*.

The foregoing descriptions of various embodiments of the invention are provided for purposes of illustration, and are not intended to be exhaustive or limiting. Modifications or variations are also possible in light of the above teachings. For example, it is possible to use more than two arms for supporting the mesh. The embodiments described above were chosen to provide the best application to thereby enable one of ordinary skill in the art to utilize the disclosed inventions in various embodiments with various modifications as are suited to the particular use contemplated. All such modifications and variations are within the scope of the invention.

The invention claimed is:

1. A system for handling a roll of mesh during application to one or more faces of an underground mine passage, comprising:

a dispenser for dispensing mesh from the roll for application to at least one face of the mine passage; and at least one flexible arm for supporting the mesh adjacent to the face upon being dispensed from the dispenser, the arm to provide tension to the mesh during the application to the at least one face of the mine passage.

2. The system of claim 1, wherein the at least one flexible arm comprises a first flexible arm for supporting the mesh, and further including a second flexible arm for supporting the mesh.

3. The system of claim 2, wherein the first and second flexible arms extend in opposite directions for biasing the mesh in a direction transverse to a longitudinal direction of the mine passage.

4. The system of claim 2, wherein the first and second flexible arms extend in generally orthogonal directions.

5. The system of claim 1, wherein the dispenser comprises a cradle for receiving the roll of mesh to engage an outer surface thereof.

6. The system of claim 5, wherein the cradle comprises at least one laterally extendable support for supporting a lateral side of the roll of mesh.

7. The system of claim 5, wherein the cradle comprises an extendable support for supporting each lateral side of the roll of mesh.

8. The system of claim 1, wherein an end of the flexible arm is adapted for positioning in an opening in the mesh.

9. A roof bolter including the mesh handling system of claim 1.

10. The roof bolter of claim 9, further including an automated temporary support for supporting at least one face of the mine passage, wherein the at least one flexible arm is supported by the automated temporary support.

11. The apparatus of claim 10, wherein the cradle comprises at least one laterally extendable support for supporting each lateral side of the roll of mesh.

12. The apparatus of claim 10, wherein the base is adapted for receiving a portion of the laterally extendable support in a telescoping fashion.

13. A roof bolter including the mesh handling system of claim 10.

14. An apparatus for handling a roll of mesh intended for application to one or more faces of a mine passage, comprising:

a cradle for dispensing the mesh from the roll, the cradle comprising a base for supporting the roll of mesh and at least one laterally extendable support for supporting a first lateral side of the roll of mesh.

15. An apparatus for intended use in connection with a vehicle for providing temporary support for a face of a mine passage and facilitating the application of mesh to the face, comprising:

a dispenser carried by the vehicle for dispensing the mesh from the roll for application to at least one face of the mine passage; and a support carried by the vehicle having at least one pad for selectively engaging and supporting the face of the mine passage, said support including at least one laterally extendable arm for engaging the mesh.

16. The apparatus of claim 15, wherein the laterally extendable arm is capable of flexing in an amount sufficient to provide tension to the mesh.

17. The apparatus of claim 16, wherein the first and second laterally extendable arms project in opposite directions.

18. The apparatus of claim 16, wherein the first and second laterally extendable arms project in generally orthogonal directions.

19. The apparatus of claim 15, wherein the support includes first and second laterally extendable arms.

20. The apparatus of claim 15, wherein the support comprises a transverse beam carrying the pad, said beam having at least one tubular end for receiving the laterally extendable arm in a telescoping fashion.

21. A method of providing supplemental support for a roof and at least one rib of an underground mine passage having a width, comprising:

dispensing mesh having a width greater than the width of the mine passage from a dispenser secured to a vehicle; and securing the mesh in the passage to cover the roof and at least one rib of the mine passage.

22. The method of claim 21, further including the step of laterally expanding the dispenser to support at least one side of the roll of mesh.

23. The method of claim 21, further including the step of providing support for the mesh adjacent to the interface between the roof and rib.

24. The method of claim 23, wherein the step of providing support comprises engaging the mesh with at least one flexible arm carried by the vehicle.

25. The method of claim 23, further including the step of anchoring the mesh to the rib.

* * * * *

UNITED STATES PATENT AND TRADEMARK OFFICE

CERTIFICATE OF CORRECTION

PATENT NO. : 8,137,033 B1
APPLICATION NO. : 12/534426
DATED : March 20, 2012
INVENTOR(S) : Hinshaw et al.

It is certified that error appears in the above-identified patent and that said Letters Patent is hereby corrected as shown below:

Replace Claim 11 with the following: --The apparatus of claim [[10]]14, wherein the cradle comprises at least one laterally extendable support for supporting each lateral side of the roll of mesh.--

Replace Claim 12 with the following: --The apparatus of claim [[10]] 11, wherein the base is adapted for receiving a portion of the laterally extendable support in a telescoping fashion.--

Replace Claim 13 with the following: --A roof bolter including the mesh handling ~~system~~ apparatus of claim [[10]] 14.--

Signed and Sealed this
Thirty-first Day of July, 2012

David J. Kappos

David J. Kappos
*Director of the United States Patent and Trademark Office*